US005207872A

United States Patent [19]

Jansson

[11] Patent Number: 5,207,872

[45] Date of Patent: May 4, 1993

[54] PRESTRESSED PRESS FRAMEWORK FOR A PAPERMAKING MACHINE

[75] Inventor: Kjell S. E. Jansson, Forshaga, Sweden

[73] Assignee: Valmet-Karlstad AB, Sweden

[21] Appl. No.: 745,934

[22] Filed: Aug. 16, 1991

[30] Foreign Application Priority Data

Mar. 29, 1990 [SE] Sweden ..... 9002758

[51] Int. Cl.[5] ..... D21F 3/00

[52] U.S. Cl. ..... 162/272; 162/358.1

[58] Field of Search ..... 162/272, 273, 274, 358, 162/358.1

[56] References Cited

U.S. PATENT DOCUMENTS 3,600,273 8/1971 McCarrick et al. ..... 162/273
4,861,431 8/1989 Törmänen ..... 162/273

FOREIGN PATENT DOCUMENTS 0319502 6/1989 European Pat. Off. .
3249733 5/1984 Fed. Rep. of Germany .
65832 3/1984 Finland .
2062042 5/1981 United Kingdom ..... 162/273

*Primary Examiner*—Karen M. Hastings
*Attorney, Agent, or Firm*—Bell, Seltzer, Park & Gibson

[57] ABSTRACT

The framework for the press of a papermaking machine or the like includes interconnected opposite side frames each having two columns. Each column on the operational side of the machine has a section that is removable to permit exchange of an endless press felt and/or other belt extending through the press nip. All four columns are axially prestressed with a force exceeding by a safety margin the tensile force induced in the respective column during operation of the press. The columns preferably are box beams. They are prestressed by hydraulic nuts connected to tension rods disposed within and extending axially of associated ones of the columns. The tension rods in the columns having a removable section are formed in two parts interconnected by a quick connect/disconnect coupling that is located proximate to the removable column section. Disengagement of the coupling permits movement by an actuator of one of the two rod parts away from the other and from the removable column section.

12 Claims, 3 Drawing Sheets

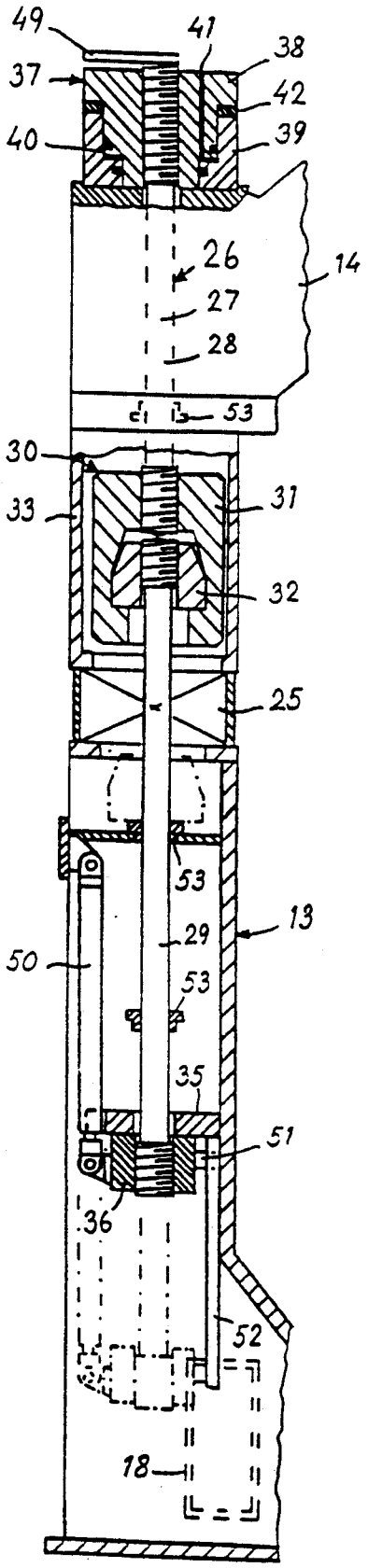
FIG. 3
FIG. 4
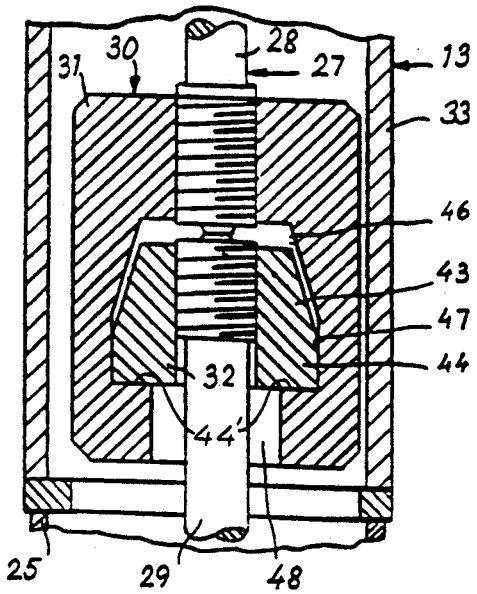
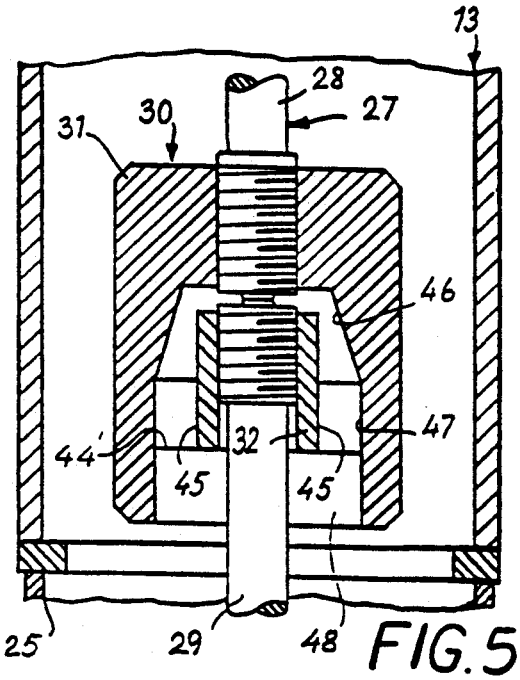
FIG. 5
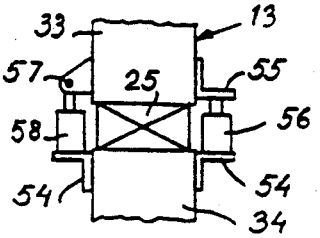
FIG. 6

PRESTRESSED PRESS FRAMEWORK FOR A PAPERMAKING MACHINE

FIELD OF THE INVENTION

This invention relates to presses for pressing fibrous webs, particularly but not necessarily exclusively those manufactured in papermaking and boardmaking machines. The invention more specifically relates to an improved framework for a press of the type having elongate press members that extend in parallel relationship to each other across the width of the machine and that are movable relative to each other in a loading/unloading direction to form a nip therebetween. At least one of the press members is located within the loop formed by an endless belt that passes through the nip with the fibrous web manufactured by the machine. The press framework includes two substantially parallel side frames which are located upon the opposite drive and operational sides of the machine. Each of the side frames has two columns that are respectively upstream and downstream of the press nip and that extend substantially parallel to each other in a vertical or other direction that is not substantially perpendicular to the loading/unloading direction of relative movement of the press members. Each of the two columns on the operational side of the machine has a section intermediate its length that is removable so as to permit replacement, when needed, of the endless belt that passes during operation of the machine through the nip between the press members.

BACKGROUND OF THE INVENTION

In a conventional paper machine press framework, the column sections above and below the removable column section are releasably interconnected by eye bolts, screws or similar threaded elements that are pivotally attached to one or the other of the upper/lower column sections and that bridge the gap present in the column when the removable section is not in place. The aforesaid threaded elements have to be very robust since they are subjected to high tension when the press is operating at its maximum permissible load. Additionally, the threaded elements are at times subjected to high bending moments.

SUMMARY OF THE INVENTION

The present invention provides an improved press framework in which the tensile forces and bending moments imposed upon the threaded elements interconnecting the column sections are of considerably lower magnitude than in the conventional press framework. As a result the threaded elements can be of substantially smaller size and/or will enjoy a longer useful life. In a preferred embodiment of the invention, each sectional column of the press framework includes prestressing means for axially prestressing such column with a compressive force at least substantially equal to the tensile force induced in the column when the nip of the press is subjected to a maximum permissible press force. Each prestressing means associated with the two columns on the operational side of the machine preferably includes an elongate tension element having two parts that are disengageable from each other at a location proximate the removable column section. When disconnected from each other, at least one of the aforesaid parts is axially displaceable in relation to the other to provide, at the aforesaid location, a gap permitting removal of the removable column section and substitution or exchange of the endless belt(s) passing between the press members.

The two parts of each tension element preferably are interconnected by a quick connect/disconnect coupling having mating socket and plug members that preferably are engageable and disengageable by relative rotation through an angle of about 90°. Such coupling reduces the time required for belt exchange.

Each of the sectional columns preferably is of hollow "box beam" construction and cross-sectional shape, and the elongate tension element of such column is disposed within and extends axially of it. The box beam construction imparts desirable high stiffness to the columns, and the interior location of the elongate tension elements protects them and lessens the possibility of their elements being subjected to bending moments caused by the prestressing. Tensioning of each tension element places the associated column under compression and preferably is accomplished by a hydraulic nut secured to its free end. The utilization of hydraulic nuts facilitates the prestressing of the columns with uniform compressive forces which preferably exceed the induced tensile force in each column by a safety margin.

DESCRIPTION OF THE PRIOR ART

The following patents may be of interest relative to the present invention: U.S. Pat. No. 3,600,273; DE 3249733C2; and FI 65832.

DESCRIPTION OF THE DRAWINGS

FIG. 3 is a view primarily in vertical section, but with some components shown in elevation, of the left column and associated prestressing means of the press framework shown in FIG. 2;

FIG. 4 is an enlarged fragmentary sectional view showing in greater detail cooperating socket and plug members of a coupling of the prestressing means shown in FIG. 3;

FIG. 5 is a sectional view similar to FIG. 4, but taken at a right angle thereto; and FIG. 6 is a simplified fragmentary side elevational view of that part of the FIG. 3 column containing and adjacent a removable column section, and of a jack and actuator associated therewith.

DESCRIPTION OF THE ILLUSTRATED EMBODIMENTS

Figure 1:
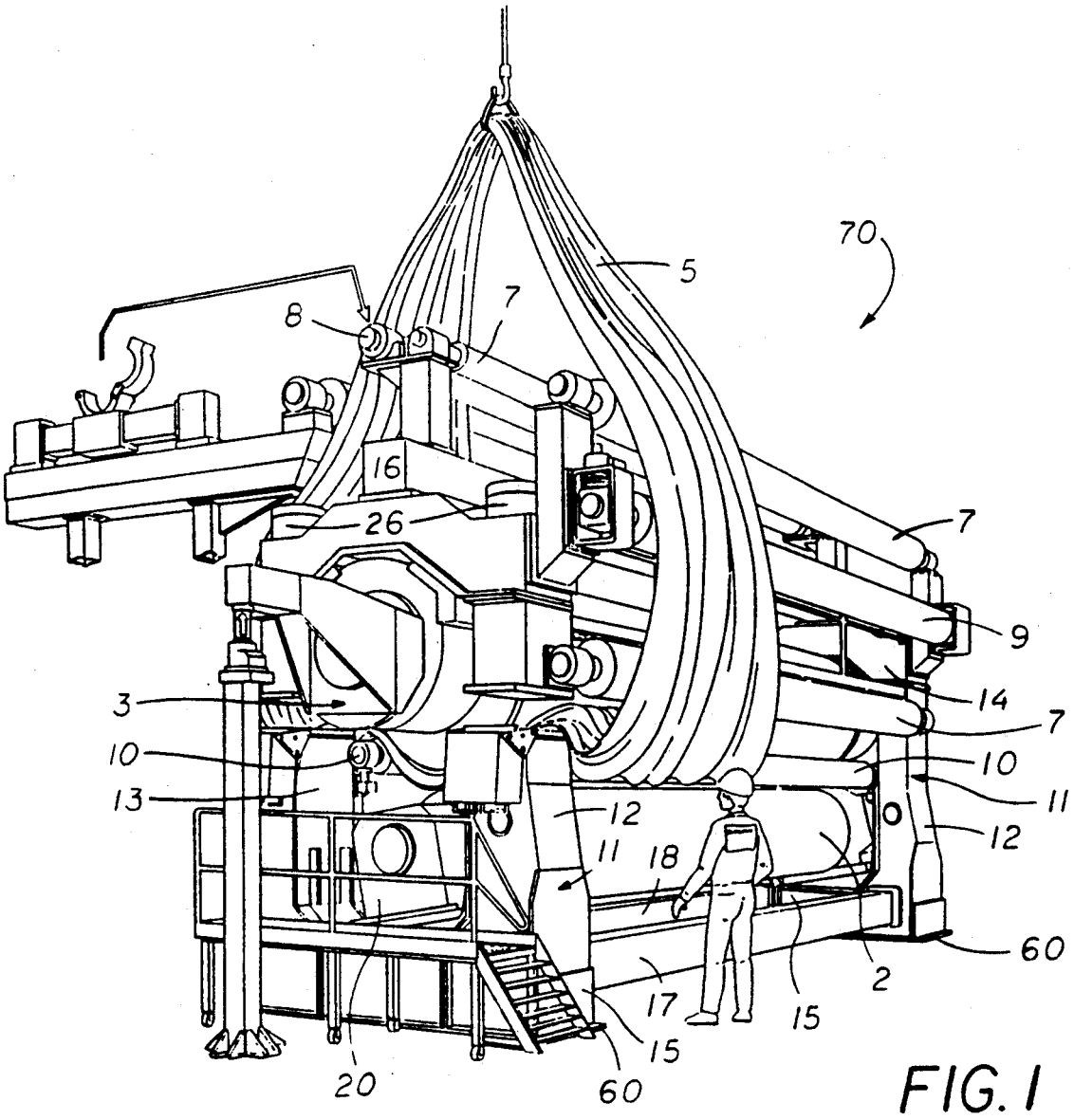
FIG. 1 is a perspective view of the operational side of a papermaking machine having a press section in accordance with the invention, components of the machine being shown in positions occupied by them during belt exchange.
Figure 2:
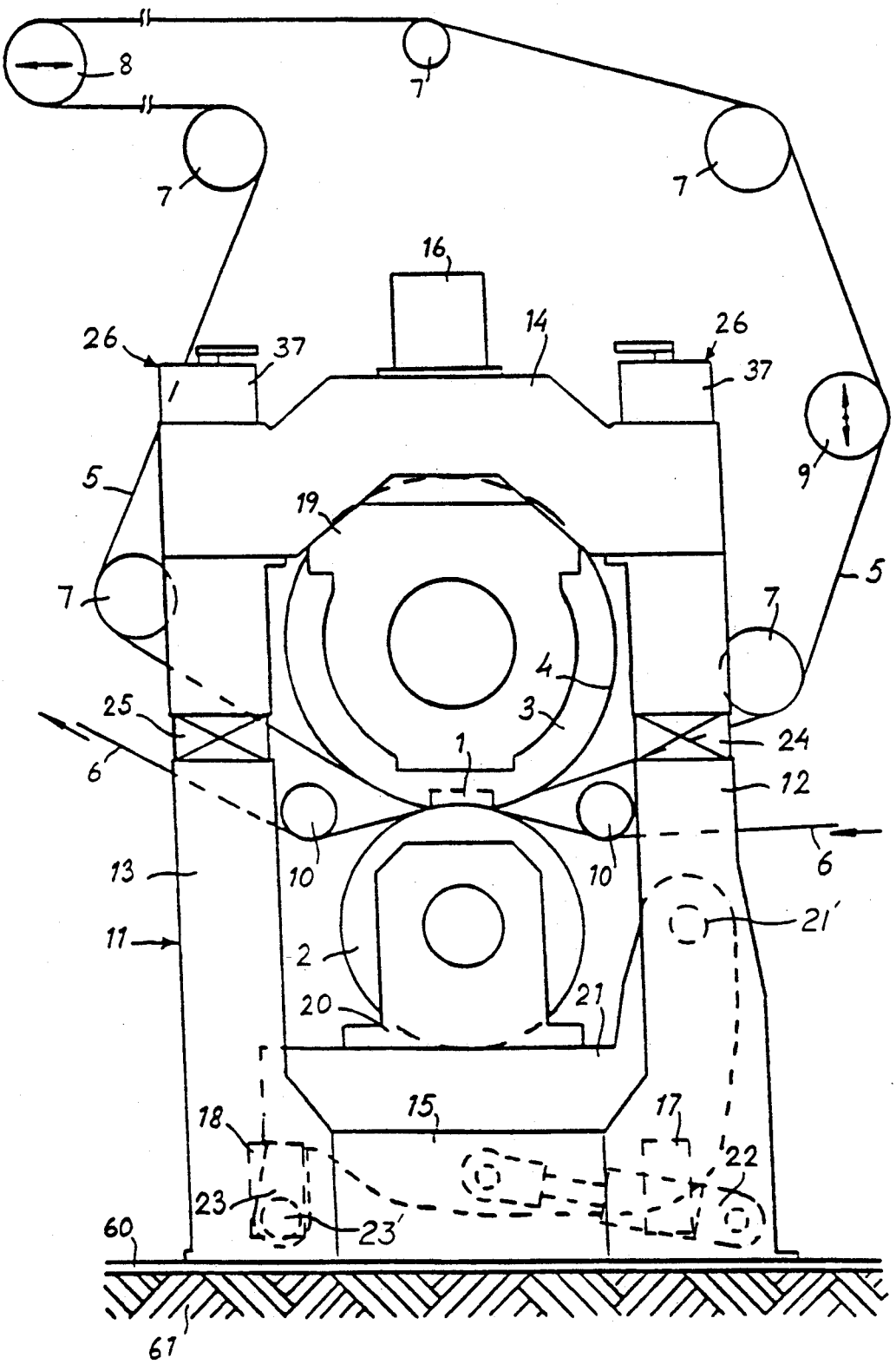
FIG. 2 is a simplified and enlarged elevational view of the operational side of the press section of the machine.

FIGS. 1 and 2 show a machine 70 for the manufacture of paper, board or similar material from a fibrous web (not shown). Machine 70 includes a press having elongate first and second press members 1, 2 which extend in substantially parallel relationship to each other across the width of the machine. At least one of the press members, illustratively member 2, is movable in an illustratively vertical loading and unloading direction toward and away from the other of the press members, so as to form a press nip therebetween. In the illustrated embodiment press member 2 is a controlled deflection roll, and the first press member 1 is a press shoe having a concave surface complementary to and forming an extended nip with press member 2. Press member 1 forms part of a shoe-type press roll 3 which has a flexible jacket 4, and preferably is of the type disclosed in co-pending and commonly assigned U.S. patent application Ser. No. 07/693,314 of Ilmarinen et al. now U.S. Pat. No. 5,084,137. In lieu of shoe-type press roll 3, a shoe press member (not shown) having an endless belt of the general type disclosed in Finnish Patent No. 65,832 might be used. In other possible but less preferred embodiments, both of the press members may be of a shoe type having a plane surface. Alternatively, both of the press members may be conventional press rolls.

Machine 70 includes at least one endless belt 5. In the illustrated embodiment this is an endless felt belt that forms a loop within which shoe-type press roll 3 is located. Belt 5 passes with the fibrous paper web 6 manufactured by machine 70 through the press nip and absorbs water pressed from web 6. In the single-felted embodiment illustrated in FIG. 2, web 6 is pressed between endless felt belt 5 and counter roll 2. However, the press may instead be double-felted, in which case counter roll 2 would then be located within the loop of the second endless press belt (not shown) and web 6 would be pressed between the two felt belts. It would also be possible to provide yet another water-receiving endless belt running, for example, through the shoe-type press nip sandwiched between press roll 3 and belt 5 for receiving water possibly passing from the web through the felt.

Belt 5 passes about guide rolls 7, a tensioning or "stretch" roll 8, and an alignment roll 9. Conventional felt conditioning equipment (not shown) is also provided in association with belt 5. Guide rolls 10 for web 6 are also provided upon opposite sides of the press nip.

The framework for the press includes two parallel side frames 11, one (not shown) located on the drive side of the machine and the other (shown in FIG. 2) on the operational side of the machine. Each of the side frames includes two columns 12, 13 respectively located upstream and downstream of the press nip. Columns 12, 13 extend parallel to each other in a direction, which preferably and illustratively is vertical, other than substantially perpendicular to the loading and unloading direction of the press. Each column 12, 13 upon the illustrated operational side of machine 70 has upper and lower sections 33, 34 respectively above and below a removable section 25 which is removed when exchange of a belt 5 is required. Lower section 34 of each column is bifurcated. The two furcations thereof are located side by side in the cross machine direction so that with respect to the side of the machine shown in FIG. 2 one of the furcations is proximate and the other is distal. Each furcation of column 12 contains a pivotally movable L-shaped lever 21, and the two levers 21 in each side frame 11 support a thereto adjacent one of the end bearings 20 of counter roll 2 for movement by an actuator 22 toward and away from press member 1. Each furcation of column 13 contains a pivotally movable support 23 that, when in its position shown in FIG. 2, supports the free end of lever 21 and the counter press member 2 in their positions shown in FIG. 2. In each of the two side frames 11 the proximate and distal pivotal supports 23 are affixed to a common shaft 23', and the proximate and distal levers 21 are similarly affixed to and interconnected by a common shaft 21'. Each actuator 22 is located in a space formed between the furcations of each of the two columns 12 and is drivably connected to its two associated levers 21.

Each side frame 11 further includes an upper cross piece 14 and a lower cross piece 15 which respectively interconnect columns 12 and 13 of such side frame at locations adjacent the respective top and bottom ends of the columns. The two side frames 11 upon opposite sides of the press are interconnected by an upper cross beam 16 anchored to a top surface of each upper cross piece 14, and by two lower cross beams 17, 18 that are anchored to a vertical surface of each column 12, 13 adjacent the lower ends thereof. The bottom of each upper cross piece 14 has a chamfered recess that receives and positions the bearing housing 19 of shoe-type press roll 3. Each side frame 11 is secured to a bottom rail 60 which in turn is secured to the underlying floor 61 (FIG. 2).

Cross pieces 14–18, columns 12, 13 and the furcations of the columns preferably are all of hollow "box beam" construction and cross-sectional shape.

In accordance with the present invention, individual prestressing means are provided for prestressing each of the four columns 12, 13 with a compressive force at least substantially equal to the tensile force induced in the respective column by the maximum permissible force generated in the press nip. The prestressing compressive force preferably exceeds the induced tensile force by an appropriate safety margin which may, for example, be on the order of 0.3 meganewtons or 25%, for example. The prestressing means for the column 13 located downstream of the press nip and on the operational side of machine 70 is generally designated by the numeral 26 in FIG. 2. Since the two prestressing means on the operational side of the machine are identical and since also the two associated columns 12 and 13 are identical apart from a minor modification required by the provision of levers 21 and actuator 22, the following description of column 13 and of the prestressing means 26 therein applies also to column 12 and the prestressing means therein.

The prestressing means 26 associated with the column 13 of FIGS. 3–6 includes an elongate two-part tension element 27, illustratively and preferably in the form of a two-part rod of circular cross-sectional shape. The two axially aligned parts 28, 29 of rod 27 are engageable with and disengageable from each other at a location adjacent removable section 25 of column 13. After disengagement of the parts 28, 29 from each other, the lower part 29 may be displaced axially downwardly from upper part 28 to a location, shown by phantom lines in FIG. 3, below removable column section 25. This permits removal of section 25 and provides a gap permitting passage through the column of press belt 5 and any other endless belt or belts involved in a belt exchange.

While the two parts 28, 29 of tension rod element 27 may be connected to each other in various ways, they preferably are connected to each other by means of a quick connect/disconnect coupling 30 that includes a socket member 31 and a matching plug member 32. As is most readily apparent from FIGS. 4 and 5, plug member 32 has a generally frusto-conical top portion 43 and a cylindrical bottom portion 44. Identical diametrically opposite sections are cut away from bottom portion 44 to provide plug member 32 with two vertical parallel sides 45. A recess of socket member 31 has a frusto-conical top portion 46 and a cylindrical bottom portion 47.

In addition, socket member 31 has at is lower end an entrance slot 48 through which plug member 32 may pass when its sides 45 are vertically aligned with entrance slot 48. Rotation of plug member 32 through an angle of approximately 90° relative to slot 48 prevents passage of the plug member through slot 48. After such rotation, outer portions of the bottom surface of plug member 32 abut two shoulders 44' within portion 44 of socket member 31. Preferably a plurality of stops (not shown) are provided on the interior walls of socket member 31 for preventing rotation of the socket member beyond its desired end positions, one of these being when its entrance slot 48 and sides 45 of plug member 32 are aligned, and another being where they form an angle of 90° relative to each other. Such stops may, for example, be screws (not shown) extending radially through the wall and into the recess of socket member 31.

Both parts 28, 29 of tension rod 27 have external screw threads upon their opposite ends. Plug member 32 of coupling 30 has mating internal threads by which it is secured to the upper end of lower part 29 of tension rod 27. Socket member 31 has mating internal threads by which it is secured to the threaded bottom end portion of upper rod part 28. When lower rod part 27 occupies its position shown in FIG. 3, a bottom nut 36 threadably connected to its lower portion abuts the bottom surface of a cross plate 35 secured within and adjacent the lower portion of the column 12 or 13 through which tension rod 27 extends. A tensioning device, which preferably and illustratively is a hydraulic nut 37, is connected by mating screws threads to the threaded upper end portion of upper rod part 28. Hydraulic nut 37 is of conventional design. It includes an inner top member 38 having a stepped outer surface, and further includes an outer bottom member 39 that abuts the top surface of cross piece 14 and has a mating stepped inner surface. An annular pressure chamber 40 between members 38, 39 communicates with a conduit 41 through which a pressurized hydraulic fluid, such as oil, is supplied to chamber 40. The pressure within chamber 40 displaces member 38 axially upwardly away from bottom member 39, and causes rod 27 to be tensioned. An annular gap is simultaneously formed between the top of the outer part of bottom member 39 and the radially extending flange of member 38. After insertion of a two-part spacer ring 42 of suitable axial thickness into the aforesaid gap, the pressure in pressure chamber 40 can be relieved since ring 42 will then maintain tension rod 27 under the desired tension. Alternatively, ring 42 may be eliminated if the flange portion of nut member 38 is an internally threaded nut (not shown) secured to mating external threads (not shown) on the main body of member 38, and the threaded nut is screwed down to bear against the top surface of member 39 while tension rod 27 is tensioned by the fluid pressure.

Releasable locking elements, such as keys (not shown) preferably are provided for preventing unintentional relative rotation between the various threaded elements of the prestressing means.

Means are provided for rotating upper part 28 of tension rod 27, and thus also socket member 31 of coupling 30, through an angle of about 90° of socket member 31 after removal of ring 42 and reduction of the pressure in chamber 40 of hydraulic nut 37. Such means preferably includes a lever arm 49 fixed to the top end of rod part 28 and extending radially therefrom. To facilitate rotation of rod part 28 and socket member 31, it is preferred that the pressure in chamber 40 be reduced sufficiently as to cause socket member 31 to move downwardly to an extent such that the outermost portions of the bottom surface of plug member 32 do not engage the two shoulders 44' within socket member 31.

A plurality of bearings 53 are provided within column 13 at spaced locations along the length of rod 27, for the purpose of maintaining the two rod parts 28, 29 aligned with each other substantially centrally of the box beam column. One bearing 53 is adjacent the top of column 13. Another is in adjacent underlying relationship to removable column section 25 and the lowermost position (shown by phantom lines in FIG. 3) of plug member 32. A third bearing 53 is mounted above column cross plate 35 by a bracket (not shown) supported upon cross plate 35.

Rod 27 and the components secured to it are moved upwardly and downwardly at desired times by a vertically extending actuator 50 (FIG. 3), which preferably is of the fluid operated piston and cylinder type. The upper end of actuator 50 is connected to column 13. The lower end of the actuator is connected to a nut member 36 upon the lower end of rod part 29. Additional guidance of the downward and upward movement of tension rod 27 is provided by a guide follower 51 carried by nut member 36 and engaging a vertically extending guide rod 52 within the lower part of column 13. The bottom positions of the movable members are shown in phantom lines and, as previously noted, the bottom position of plug member 32 is sufficiently below removable column section 25 as to not obstruct removal and insertion of section 25.

To facilitate removal and insertion of column section 25 after lowering of lower rod part 29 and the therewith associated plug member 32 and bottom nut member 36 to their bottom positions, two brackets 54, 55 (FIG. 6) preferably are mounted upon column 13 at locations immediately above and below section 25. By positioning a jack 56 between the brackets, the column section 33 above removable section 25 can be lifted a few millimeters to permit easy removal and subsequent replacement of section 25. As is shown at the left side of FIG. 6, a pivot joint 57 connected to the movable member of an actuator 58 may be substituted for upper bracket 55 and jack 56, or used in association therewith. When not in use, actuator 58 may be rotated through an angle of 180° about pivot joint 57 so as to occupy a vertical inactive position above the pivot joint. Deactivation of jack 56 and/or actuator 58 allows upper column section 33 to descend somewhat, but still leaves a gap between column sections 33, 34 that is of sufficient size, following removal of jack 56 and/or actuator 58, as to permit free passage of the belt(s) 5 involved in the belt exchange.

The two columns of the side frame upon the drive side of machine 70 do not have any removable section similar to section 25, and the tension rods used for prestressing these columns each consist of a single rod that extends from the hydraulic nut at its upper end thereof to the bottom nut member at its lower end. Consequently, such columns do not need or have quick connect/disconnect couplings, actuators, guide followers or guide rods similar to coupling 30, actuator 50, guide follower 51 and guide rod 52.

When terms such as "columns," "upper," "lower," "vertical," "horizontal," and the like are used herein, the same should be interpreted as describing relative positions. For example, in an embodiment wherein the loading and unloading direction of the press is horizontal, rather than vertical as illustrated in the drawings, "columns" 12 and 13 would be horizontal instead of vertical.

While preferred embodiments of the invention have been shown and described, this was for purposes of illustration only, and not for purposes of limitation, the scope of the invention being in accordance with the following claims.

I claim:

1. In a machine for the manufacture of a fibrous web; said machine including a press having framework, a first press member and a cooperating second press member; said press members being elongate and extending generally parallel to each other in the width direction of said machine; at least one of said press members being movable relative to the other of said press members in a loading/unloading direction to form a press nip with the other of said press members; at least one endless belt, one of said press members being located within the loop formed by said endless belt, said belt and said web passing together through said nip during operation of said machine; said framework of said press including first and second side frames extending in substantially parallel relationship to each other upon respective operational and drive sides of said machine, each of said side frames having two columns extending in parallel relationship to each other in a direction other than substantially perpendicular to said loading/unloading direction, one of said columns being located upstream of said press nip and the other of said columns being located downstream of said press nip, each of said columns on said operational side of said machine having a removable section intermediate its length for permitting exchange of said endless belt, the improvement comprising:

a plurality of prestressing means, each of said prestressing means being associated with a respective one of said columns for prestressing each of said columns axially with a compressive force at least substantially equal to the tensile force induced in said column by a maximum permissible press force in said nip, said prestressing means being structured and arranged for keeping said columns under axial compressive prestress during operation of said press, and each of said prestressing means associated with respective ones of said columns on said operational side of said machine including an elongate tension element having two parts, said two parts being disengageable from each other at a location proximate said removable column section, at least one of said two parts being axially displaceable, when disconnected from the other of said parts, to form at said location a gap permitting removal of said removable section of said column and exchange of said endless belt.

2. A machine as in claim 1, and further including a quick connect/disconnect coupling interconnecting said two parts of said tension element, said coupling including a socket member and a matching plug member.

3. A machine as in claim 2, wherein said coupling members are engageable and disengageable by rotation of one of said coupling members through an angle of approximately 90° relative to the other of said coupling members.

4. A machine as in any of claims 1, 2 or 3, wherein each of said columns is of box beam cross-sectional shape, and the therewith associated one of said tension elements is disposed within and extends axially of said column.

5. A machine as in any of claims 1, 2 or 3, wherein each of said prestressing means further includes a hydraulic nut engaging an end of the associated one of said tension elements and at desired times tensioning said tension element.

6. A machine as in any of claims 1, 2 or 3, wherein each of said prestressing means is structured and arranged to impose a compressive force upon the associated one of said columns of a magnitude exceeding by a preselected safety margin said tensile force induced in said column.

7. A machine for making a paper product from a fibrous web, said machine having a press for pressing said web, at least one endless belt that moves with said web through said press, and a plurality of vertical columns within which tensile forces are induced during operation of said press; the improvement comprising:

a plurality of prestressing means, each of which includes an elongate tensioning element disposed within and extending longitudinally of a respective one of said columns for prestressing each of said columns axially with a compressive force at least substantially equal to said tensile force induced in said column, said tensioning elements being structured and arranged for keeping said columns under axial compressive prestress during operation of said press.

8. A machine as in claim 7, wherein at least one of said columns has a removable section intermediate its length for facilitating exchange of said belt.

9. A machine as in claim 8, wherein the tensioning element associated with said at least one column includes a first part and a second part, and a quick connect/disconnect coupling releasably interconnecting said parts of said tensioning element.

10. A machine as in claim 9, wherein said coupling includes a socket member and a matching plug member connectable and disconnectable by relative rotation.

11. A machine as in claim 9, and further including an actuator connected to said tensioning element associated with said at least one column for at desired times moving one of said parts of said tensioning element relative to the other of said parts of said element.

12. A machine as in claim 7, and further including a plurality of hydraulic nuts connected to associated ones of said tensioning elements.

* * * * *